US007513444B1

(12) United States Patent
Kurimski et al.

(10) Patent No.: US 7,513,444 B1
(45) Date of Patent: Apr. 7, 2009

(54) PORTABLE SPRAYING APPARATUS FOR BUCKETS OR THE LIKE

(75) Inventors: Michael J. Kurimski, Pleasant Hill, IA (US); Mark A. Seeley, Sigourney, IA (US)

(73) Assignee: SMK Industries, Inc., Sigourney, IA (US)

( * ) Notice: Subject to any disclaimer, the term of this patent is extended or adjusted under 35 U.S.C. 154(b) by 353 days.

(21) Appl. No.: 11/549,821

(22) Filed: Oct. 16, 2006

(51) Int. Cl.
*B05B 9/04* (2006.01)

(52) U.S. Cl. ..... 239/332; 239/333; 239/373; 239/530; 239/532; 239/600; 222/153.01; 222/333; 222/383.1; 220/322; 220/756; 220/773; 220/810; 215/286

(58) Field of Classification Search ..... 239/302, 239/332, 333, 373, 525, 530, 532, 600; 222/153.01, 222/153.09, 333, 383.1, 383.2, 385; 220/322, 220/756, 773, 810, 833, 834; 215/280, 286
See application file for complete search history.

(56) References Cited

U.S. PATENT DOCUMENTS 1,727,087 A * 9/1929 Wendle ..... 220/322
1,862,730 A * 6/1932 Wendle ..... 220/756
3,960,289 A * 6/1976 Panicci ..... 220/322
4,192,464 A * 3/1980 Chow ..... 239/373
4,881,687 A * 11/1989 Ballu ..... 239/332
5,135,127 A * 8/1992 Ross ..... 220/322
5,931,351 A * 8/1999 Renualt et al. ..... 215/286
6,726,065 B2 * 4/2004 Sanders ..... 222/333
7,207,500 B2 * 4/2007 Hudson et al. ..... 239/332

OTHER PUBLICATIONS 7 sheets showing a "Spray N' Pail"—from an Internet website—by Progressive Construction Systems Corporation-2005.

* cited by examiner

*Primary Examiner*—Steven J Ganey
(74) *Attorney, Agent, or Firm*—Sturm & Fix LLP

(57) ABSTRACT

An apparatus for attachment to a bucket for holding a liquid is attached to a bucket with an upper rim. A bail is pivotally attached to the bucket as in a conventional arrangement, the bail having an upper position and a lower position. The apparatus has a housing with a pump operatively attached thereto, the pump having an inlet in liquid communication with the bucket and an outlet for facilitating the pumping of liquid from the bucket, preferably through a spray wand with a nozzle at the outlet thereof. A member is pivotally attached to the housing at one end thereof and has a notch in another portion thereof. This member has at least a first pivotal position and a second pivotal position. When housing is on the rim, the bail is in the upper position thereof and the member is in the first pivotal position thereof so that a portion of the bail is in the notch for thereby holding the housing to the upper rim of the bucket. The pivoting member can also hold a rechargeable battery securely in place in the first position of the member. This apparatus thereby permits a user to purchase a liquid to be sprayed in a bucket and then attach the present invention thereto to spray the liquid contents of the bucket as desired, thereby obviating both the need to transfer the liquid to a sprayer tank and the need for an extension cord for electricity.

20 Claims, 4 Drawing Sheets

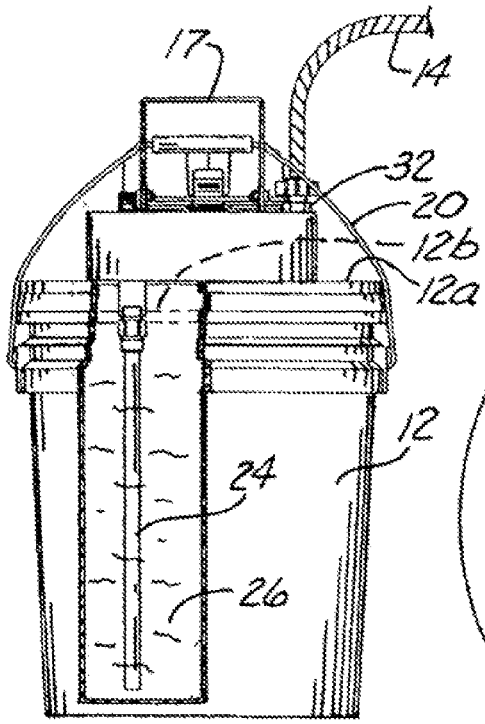
Fig. 7
Fig. 8
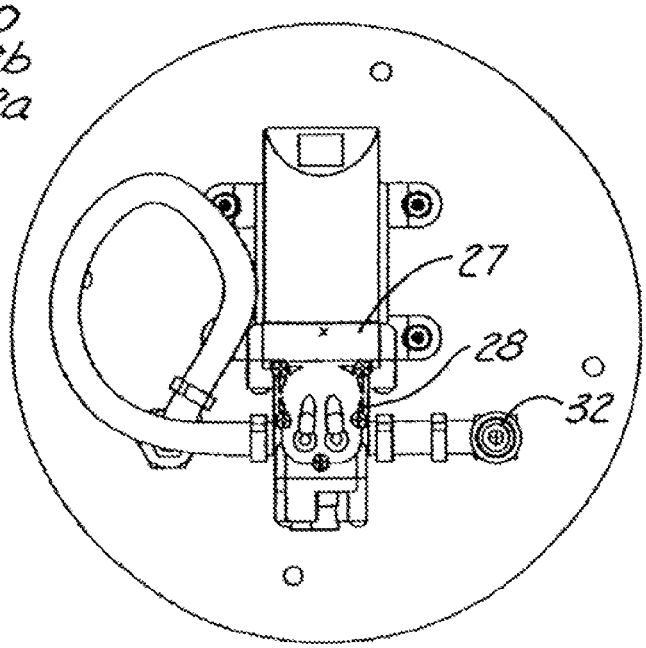
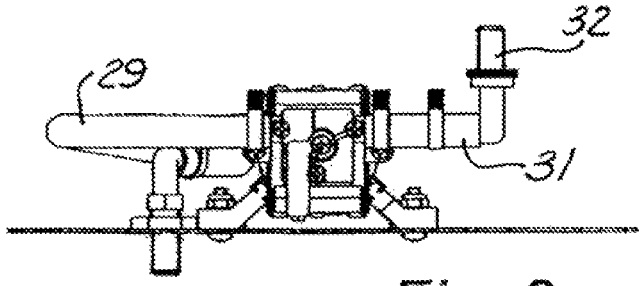
Fig. 9
Fig. 10
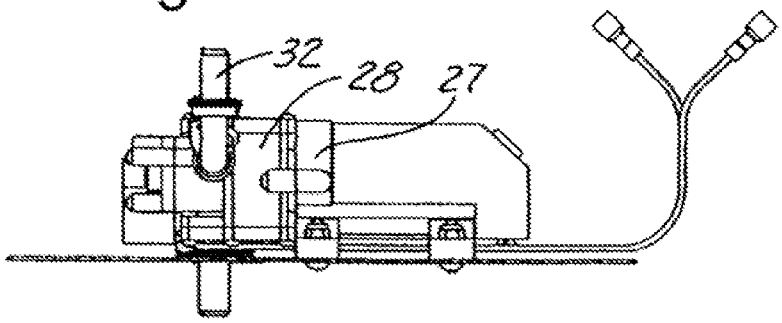

PORTABLE SPRAYING APPARATUS FOR BUCKETS OR THE LIKE

CROSS REFERENCE TO RELATED APPLICATIONS

None.

BACKGROUND OF THE INVENTION

1. Field of the Invention

The present invention relates to spraying equipment, and more particularly to a device which can be attached to the top of a bucket for spraying liquid from the bucket.

2. Description of Related Art

Many liquids that are to be sprayed are sold in buckets, particularly in five gallon plastic buckets. Such liquids can include paints, sealers for concrete or asphalt surfaces, roofing sealer, etc. Typically such liquid is purchased, taken to the job site and then poured into another container associated with a sprayer before the actually spraying is done. Of course this step of transferring the liquid to another container takes time. Furthermore the container to which the liquid is transferred will need to be cleaned at times, especially if a different liquid is to be sprayed than the one last used in such container.

Electrically operated sprayers often need an electrical outlet in order to be operable. That is not always convenient because the spraying may be needed at a location remote from electrical power. Additionally, even if an extension cord will reach an outlet, the extension cord itself can create a safety hazard or make the spraying more difficult because it gets in the way or may even pick up liquid from the sprayer or sprayed surface.

Accordingly there is a need for spraying equipment to overcome these problems with prior art devices.

SUMMARY OF THE INVENTION

The present invention relates to a spraying apparatus which can be attached directly to a bucket in which a liquid is sold. One part of the invention is an apparatus which permits the bail of such bucket to be used to lock the spraying apparatus to the bucket so that the spraying apparatus is held securely in place while the liquid is sprayed directly from the container in which it is sold. Another part of the invention uses a rechargeable battery of the type used in power tools, and which is held securely in place during the process of spraying a liquid directly from a bucket.

BRIEF DESCRIPTION OF THE DRAWINGS

The present invention will be more fully understood from the detailed description below when viewed in conjunction with the accompanying drawings in which:

FIG. 2 is a front elevational view of the present invention installed on a plastic bucket of a type that liquids are commonly sold in;

FIG. 7 is a front elevational view, like FIG. 2, but with a portion of the bucket broken away to show the inlet conduit and, in dashed lines, an optional lid portion;

FIG. 8 is a top view with a portion of the housing removed to show the pump, motor and parts of the inlet and outlet conduits connected to the pump;

FIG. 9 is a side elevational view of FIG. 8; and

FIG. 10 is a view taken ninety degrees around the device from the elevational view shown in FIG. 9.

DETAILED DESCRIPTION OF THE INVENTION

Figure 1:
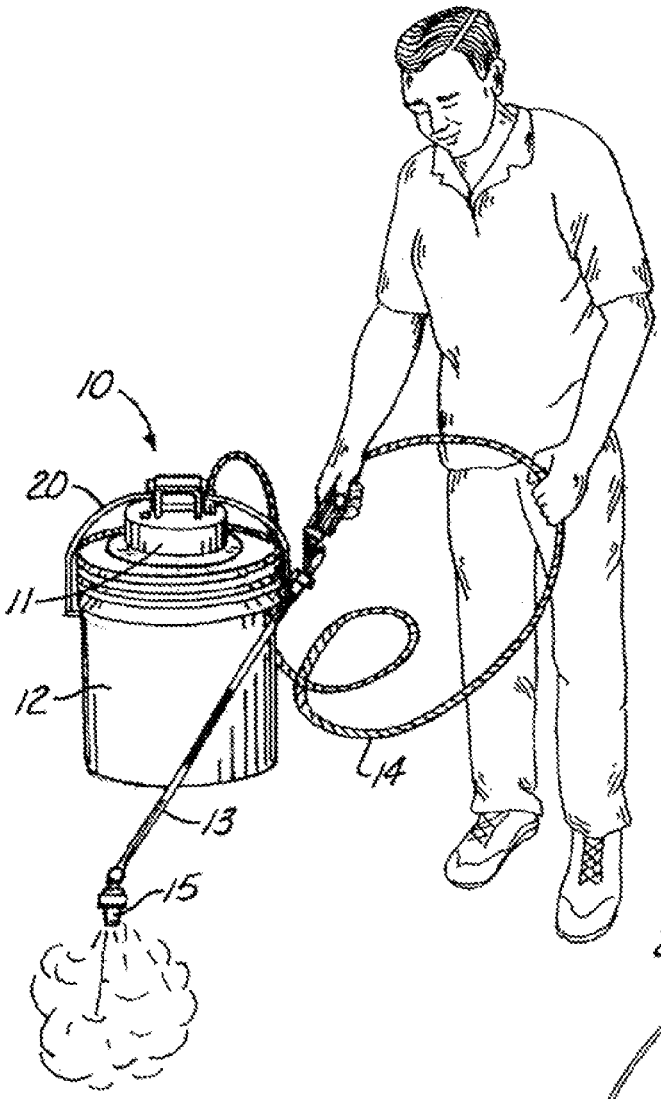
FIG. 1 is a perspective view of a user of the present invention spraying a liquid directly from a bucket in which the liquid was sold.
Figure 2:
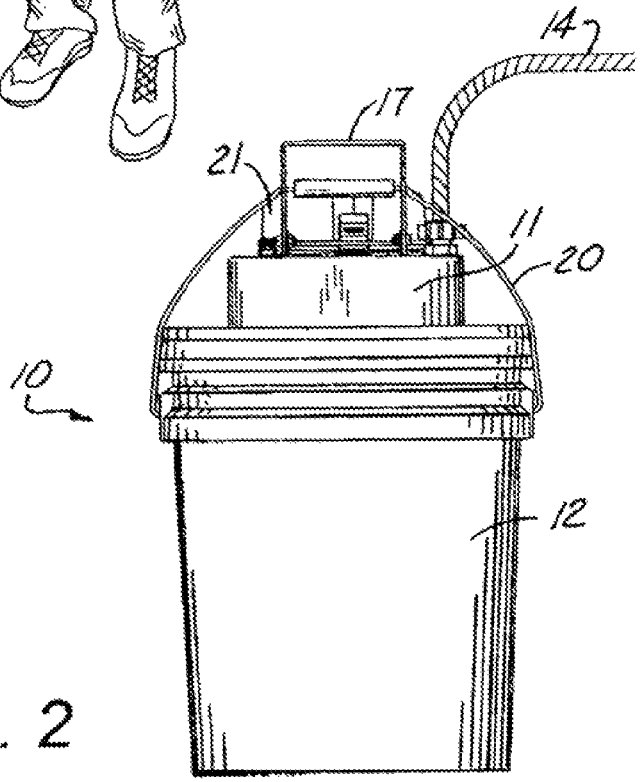

Referring now to the drawings wherein like reference numerals designate identical or corresponding parts throughout the several views, FIG. 1 shows a device 10 constructed in accordance with a preferred embodiment of the present invention and being used to spray a sealant on concrete.

FIGS. 1-6 show the invention 10 with a housing 11 with a housing plate 11*a* attached thereto. The housing 11/11*a* is attached to a bucket 12 so that liquid 26 in the bucket can be sprayed out of hose 14 and sprayer wand 13 through nozzle 15.

Figure 6:
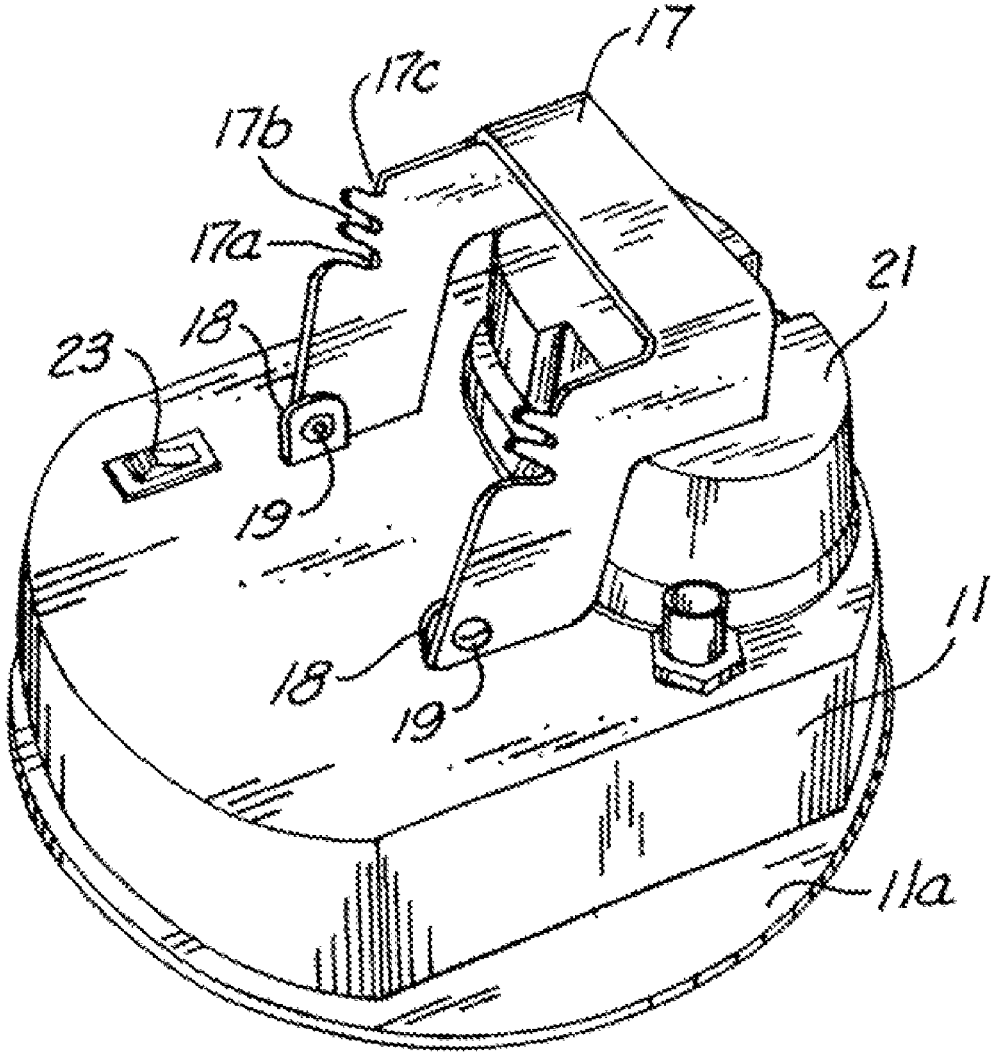
FIG. 6 is a perspective view of the present invention before the outlet hose and wand and bucket are connected thereto.

A member 17 is pivotally attached to the housing 11, as shown in FIG. 6, by threaded fasteners 19 that extend through flanges 18 attached to the top of housing 11. The member 17 has notches 17*a*, 17*b* and 17*c*, though more or less notches can be used as will be explained below. Portion 17*d* of member 17 abuts the top of a rechargeable battery 21, which will be discussed below.

Figures 3, 4, 5:
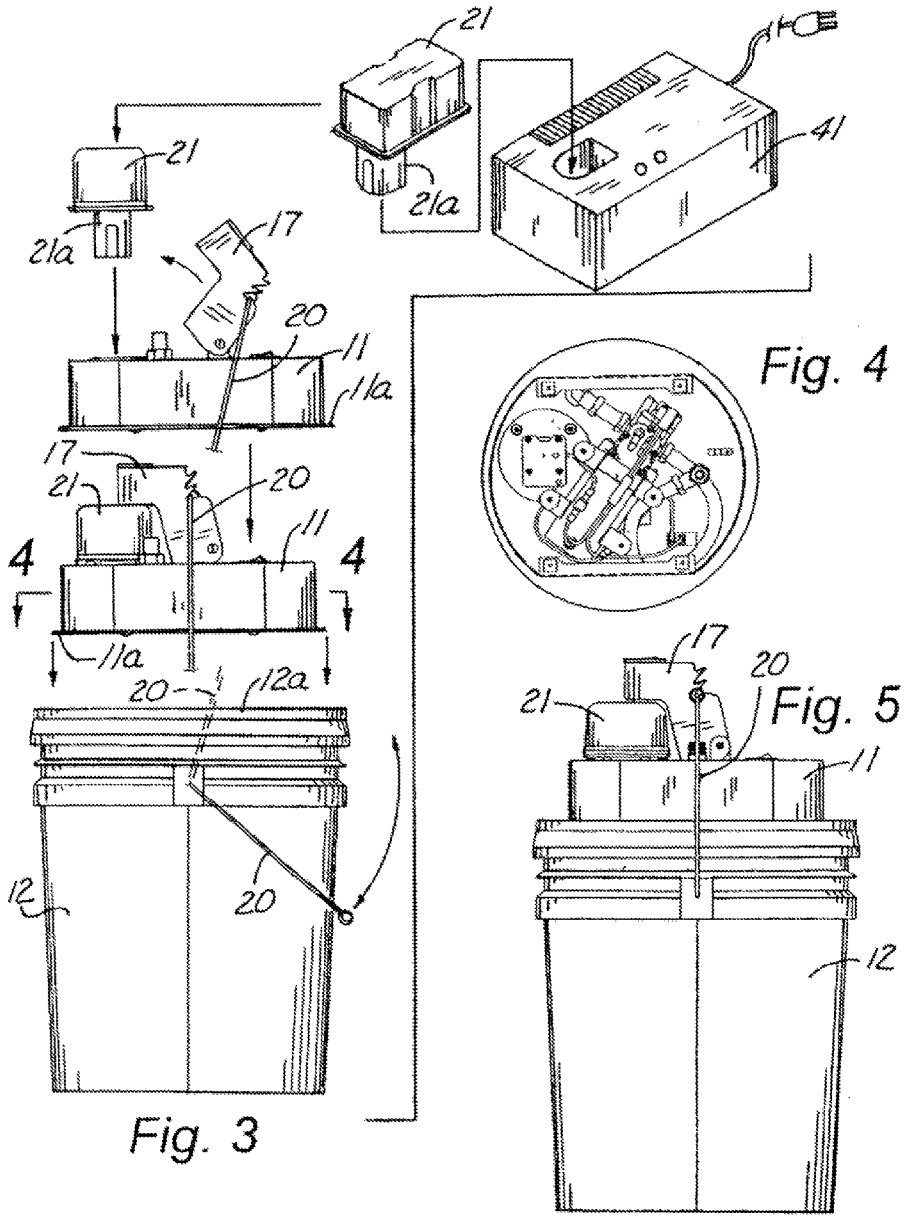
FIG. 3 is an exploded view of the present invention showing how it attaches to a bucket containing a liquid and how a rechargeable battery of the electric power tool type is used.
FIG. 4 is a cross sectional view taken along line 4-4 of FIG. 3 to show the pump, motor, inlet and outlet conduits of the present invention.
FIG. 5 is a side elevational view of the present invention showing how a bail of the bucket is locked into a slot on a member on the top of the invention to securely hold the invention to the bucket and showing two extra slots to accommodate larger bails than the one shown.

The device shown in FIG. 6 can be attached to a bucket 12 full of liquid 26 as shown in FIGS. 3-7. FIG. 3 shows how a rechargeable battery 21 with a projection 21*a* with plus and minus contacts thereon can be alternatively plugged into and attached to the top of the housing 11 and held in place by the member 17 or plugged into a charger 41 of the type commonly used in portable power tools such as electric drills. Furthermore, the device shown in FIG. 6 can be placed on top of a bucket 12 in the manner shown in FIG. 3 and once in place the bail 20, with handle 20*a*, can be moved to the position shown in FIG. 5 so that the bail is in notch 17*a*. This will hold, by friction, the device of FIG. 6 securely to the bucket 12. The bail 20 is typically made of steel which will act as a spring when stretched to go into the notches 17*a* and then pull the housing 11 downwardly to keep the bail 20 in the notches 17*a*. If a larger bail 20 is used, then one of the higher notches 17*b* or 17*c* would be used instead of notches 17*a*. In this way the bail 20 and the pivoting member 17 hold the housing 11 onto the bucket 12 and at the same time hold the battery 21 securely in place by contact of 17*d* with the top of the battery 21.

As shown in FIG. 3 going sequentially from top to bottom, the latch member 17 on top of the pump 28 should not be rotated or latched until the bucket handle bail 20 is rotated up to engage one of the sets of notches such as 17*a*, then both the latch member 17 and bucket handle bail 20 will pivot simultaneously, counterclockwise as shown in FIG. 3. Once the latch member 17 and bucket handle bail 20 are engaged, when rotated counterclockwise, they will cam or toggle over the center point, locking the pump assembly to the bucket 12 and securing the battery 21.

Of course rechargeable batteries 21 come in various sizes, shapes, voltages, etc. If a person prefers a certain brand of power tools, then such person would most likely want to purchase one of these devices 10 that would use the same size and shape of battery as in that person's power tools. Accordingly the invention 10 can be modified as needed to accommodate various sizes and shapes of rechargeable batteries 21.

Before or after the housing 11 is attached as shown in FIG. 5, the hose 14, wand 13 and nozzle 15 can be attached. Similarly, the inlet conduit 24 is operatively attached to the inlet of the pump 28 through conduit 29, which is in liquid communication with conduit 24. The pump is powered by an electric motor 27. This conduit 24 can go through a hole in optional lid. In other words, the device can be attached to a bucket 12 that has a lid with a hole in it or the device can be attached to a bucket without a lid. The upper rim 12*a* can represent the top rim of a bucket lid or upper rim 12*a* can represent the top of the bucket 12 with no lid on it. In most instances the bucket 12 will have a lid on it when such bucket 12 is purchased with a liquid to be sprayed inside. That being the case, the lid would preferably remain on the bucket 12 during use of the present invention.

Looking to FIGS. 8-10, the outlet of the pump 28 has an outlet conduit 31 and a fitting 32 operatively attached thereto so that the hose 14 can be attached to fitting 32 and thereby be in liquid communication with the outlet of the pump 28. Once all of the parts are assembled as shown in FIGS. 1 and 7, it is just a matter of spraying all of the liquid 26 from the bucket 12 and then attaching it to another bucket 12 that has been purchased that is full of liquid 26. This is done instead of just filling the emptied bucket 12.

Accordingly, it will be appreciated that the preferred embodiments do indeed overcome the deficiencies of the prior art explained above. Obviously many modifications and variations of the present invention are possible in light of the above teachings. It is therefore to be understood that, within the scope of the appended claims, the invention may be practiced otherwise than as specifically described.

We claim:

1. Apparatus comprising:

a bucket for holding a liquid, the bucket having an upper rim;

a bail pivotally attached to the bucket, the bail having an upper position and a lower position;

a housing having an upper portion and a lower portion;

a pump operatively attached to the housing, the pump having an inlet in liquid communication with the bucket and an outlet for facilitating the pumping of liquid from the bucket;

a member pivotally attached to the housing at one end thereof and having a notch in another portion thereof;

the member having a first pivotal position and a second pivotal position; and wherein when housing is on the rim, the bail is in the upper position thereof and the member is in the first pivotal position thereof, a portion of the bail is in the notch for thereby holding the housing to the upper rim of the bucket.

2. The apparatus of claim 1 wherein the upper rim of the bucket is part of a lid.

3. The apparatus of claim 2 wherein the lid has a hole in it for receiving an inlet tube therethrough, the inlet tube being in liquid communication with the inlet of the pump.

4. The apparatus of claim 1 wherein a spray nozzle is operatively connected to the outlet of the pump.

5. The apparatus of claim 1 wherein a spraying wand having an outlet nozzle is operatively attached to the outlet of the pump.

6. The apparatus of claim 1 wherein the pump is an electrically operated pump.

7. The apparatus of claim 6 wherein a battery is operatively attached to the housing.

8. The apparatus of claim 7 wherein the battery is disposed between the housing and the member when the member is in the first pivotal position thereof.

9. The apparatus of claim 8 wherein the member prevents the battery from moving in at least one direction when the member is in the first pivotal position thereof.

10. The apparatus of claim 6 wherein the battery is a rechargeable battery of the type used in portable power tools.

11. The apparatus of claim 10 wherein the rechargeable battery has a projection thereon with positive and negative contacts thereon which extends into positive and negative contacts on the housing which are connected to respective positive and negative contacts on a motor that selectively operates the electrically operated pump.

12. The apparatus of claim 11 including a battery charger for selectively receiving the projection of the rechargeable battery for charging purposes.

13. The apparatus of claim 1 wherein the bail also comprises a handle.

14. Apparatus comprising:

a bucket for holding a liquid, the bucket having an upper rim;

a housing having an upper portion and a lower portion;

an electrically operated pump operatively attached to the housing, the pump having an inlet in liquid communication with the bucket and an outlet for facilitating the pumping of liquid from the bucket;

a member pivotally attached to the housing at one end thereof;

the member having a first pivotal position and a second pivotal position; and a rechargeable battery operatively connected to the pump, the battery being disposed between the member and the housing when the member is in the first pivotal position thereof for holding the battery securely in place.

15. The apparatus of claim 14 wherein the upper rim of the bucket is part of a lid.

16. The apparatus of claim 15 wherein the lid has a hole in it for receiving an inlet tube therethrough, the inlet tube being in liquid communication with the inlet of the pump.

17. The apparatus of claim 14 wherein a spray nozzle is operatively connected to the outlet of the pump.

18. The apparatus of claim 14 wherein a spraying wand having an outlet nozzle is operatively attached to the outlet of the pump.

19. The apparatus of claim 14, further comprising: a bail pivotally attached to the bucket, the bail having an upper position and a lower position;

the member having a notch in another portion thereof; and wherein when the housing is on the rim, the bail is in the upper position thereof and the member is in the first pivotal position thereof, a portion of the bail is in the notch for thereby holding the housing to the upper rim of the bucket.

20. The apparatus of claim 19 wherein the member has more than one notch therein at a level higher or lower than a level of first said notch when the member is in the first pivotal position thereof to thereby accommodate bails of different sizes.

* * * * *